United States Patent [19]

Mueller

[11] Patent Number: 4,502,625

[45] Date of Patent: Mar. 5, 1985

[54] FURNACE CONTROL APPARATUS HAVING A CIRCULATOR FAILURE DETECTION CIRCUIT FOR A DOWNFLOW FURNACE

[75] Inventor: Dale A. Mueller, New Hope, Minn.

[73] Assignee: Honeywell Inc., Minneapolis, Minn.

[21] Appl. No.: 528,294

[22] Filed: Aug. 31, 1983

[51] Int. Cl.[3] ..... F24D 5/10

[52] U.S. Cl. ..... 236/11; 236/46 E; 431/78

[58] Field of Search ..... 236/9 R, 9 A, 10, 11, 236/46 E; 431/77, 78; 62/231

[56] References Cited

U.S. PATENT DOCUMENTS

| | | | |
|---|---|---|---|
| 1,304,822 | 5/1919 | Teeple | 431/78 |
| 2,143,569 | 1/1939 | Nessell | 236/11 |
| 2,363,696 | 11/1944 | Russel | 431/78 X |
| 4,369,916 | 1/1983 | Abbey | 236/11 |

OTHER PUBLICATIONS

Electric Controls, B. C. Langley, 1974, Prentice Hall, Inc.

*Primary Examiner*—William E. Wayner

*Attorney, Agent, or Firm*—Mitchell J. Halista; Trevor B. Joike

[57] ABSTRACT

A furnace control apparatus for a downflow forced warm air furnace uses a microprocessor and thermostat to initiate and control the start-up of the furnace. During the initial start-up operation, the microprocessor receives an input signal from the thermostat indicative of the need for a furnace operation and produces an output signal for controlling, in combination with the thermostat which responds to the temperature of the space to be heated, an actuation of a gas valve to supply gas to the furnace. Subsequently, an analog temperature sensor in an air supply duct is used to supply another input signal through an analog-to-digital converter to the microprocessor representative of the air temperature in the duct. The microprocessor stores the value of the air temperature following the start-up of the burner and subsequently turns on an air circulator.

20 Claims, 5 Drawing Figures

FIG. 1
PRIOR ART
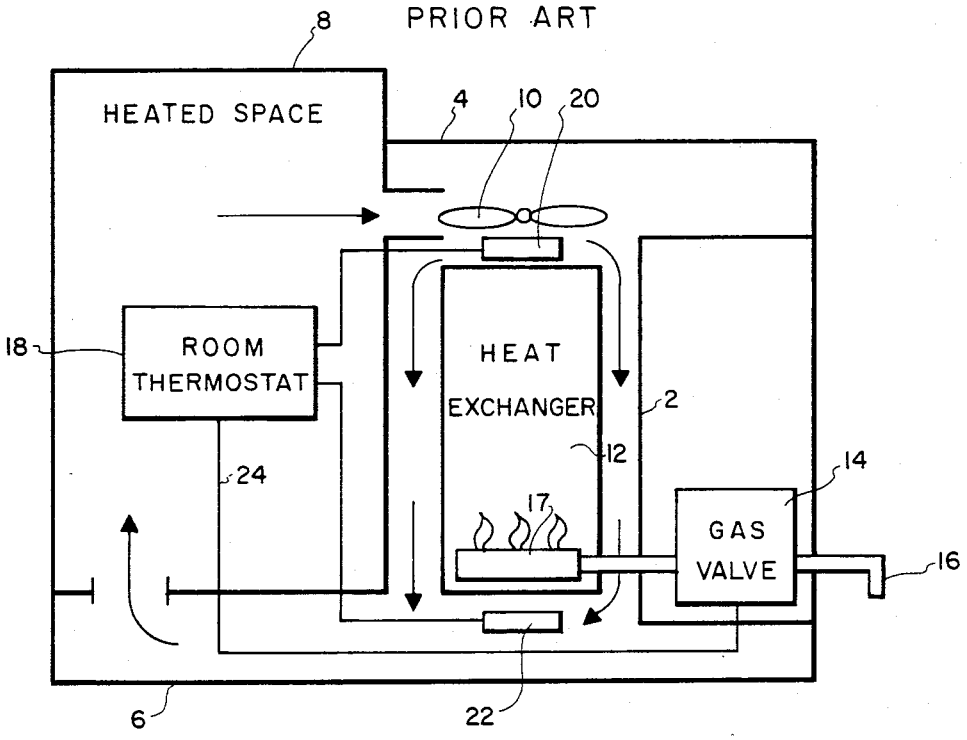
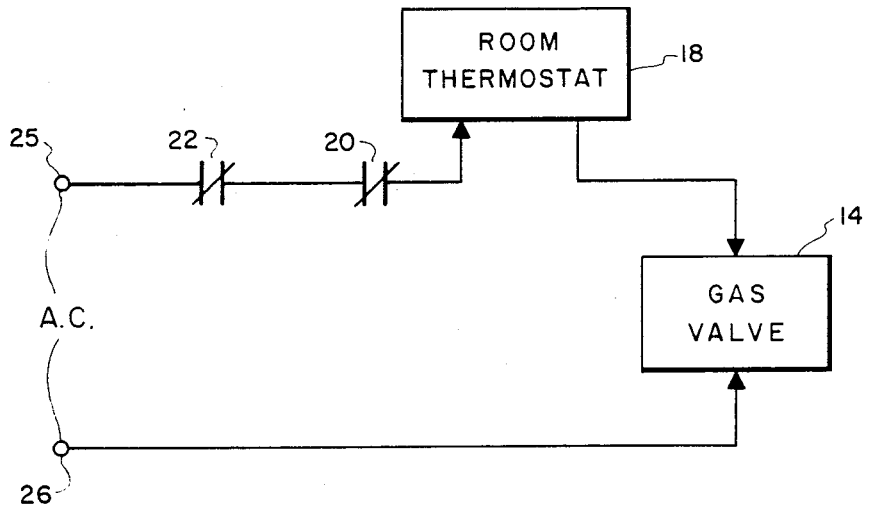
FIG. 2
PRIOR ART

FURNACE CONTROL APPARATUS HAVING A CIRCULATOR FAILURE DETECTION CIRCUIT FOR A DOWNFLOW FURNACE

BACKGROUND OF THE INVENTION

Field of the Invention

The present invention relates to furnace controls. More specifically, the present invention is directed to a furnace control apparatus having a heating medium circulator failure detector for a downflow furnace.

SUMMARY OF THE INVENTION

An object of the present invention is to provide an improved furnace control apparatus having a heating medium circulator failure detector for a downflow furnace.

In accomplishing this and other objects, there has been provided, in accordance with the present invention, a furnace control apparatus utilizing a heating medium circulator means for delivering a heating medium heated by the furnace, a temperature detector for sensing the temperature of the heating medium delivered from the furnace by the circulator means and a fuel control means for turning off the fuel supplied to the furnace when the temperature of the delivered heating medium remains below a predetermined reference temperature within a preset time period following a start of the operation of the heating medium circulator.

BRIEF DESCRIPTION OF THE DRAWINGS

A better understanding of the present invention can be had when the following detailed description is read in connection with the accompanying drawings, in which:

FIG. 1 is a pictorial illustration of a conventional downflow forced warm air furnace having a circulator failure detection system, FIG. 2 is a schematic illustration of the control system shown in FIG. 1.

DESCRIPTION OF THE PREFERRED EMBODIMENT

Detailed Description

Figure 3:
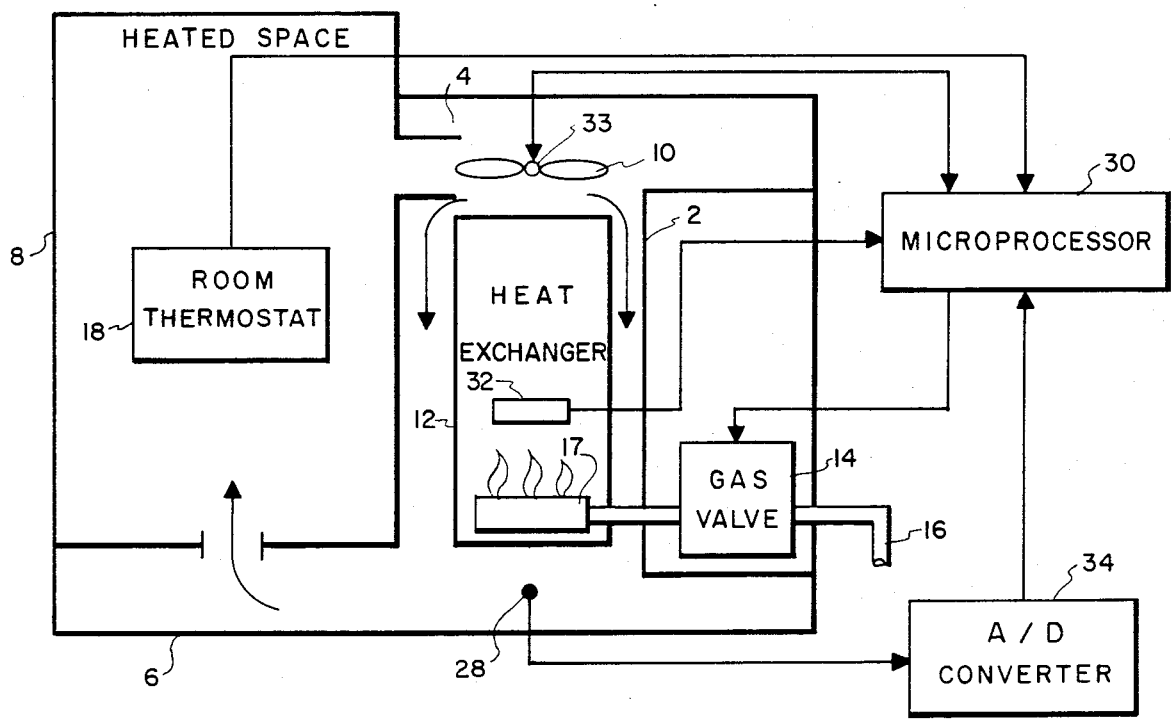
FIG. 3 is a pictorial illustration of a downflow forced warm air furnace having an air circulator failure detector embodying an example of the present invention.

Referring to FIG. 1 in more detail, there is shown a conventional circulator detection system for a downflow forced warm air furnace. A downflow furnace 2 is connected through a supply duct 4 and a delivery duct 6 to a heated space 8. In such a downflow furnace system, the return air from the heated space 10 enters the top of the furnace 2 and, after being heated, exits from the bottom of the furnace 2, i.e., the flow of air is artifically induced by an air circulator to be counter to a temperature induced air flow, i.e., convection. The advantage of such a heating system is that the return air passage 4 may be through a hallway while the delivery air path 6 is through ductwork under the floor. This is particularly advantageous for mobile homes applications of the furnace by minimizing the intrusion of the heating system into the living space within the mobile home.

Two of the approval tests for this type of furnace are directed toward determining restructed return airflow and an air circulator failure. An air circulator 10, e.g., a fan, is used to direct return air from the heated space 8 along a heat exchanger 12 to increase the temperature of the return air before delivering it to the delivery duct 6. A gas valve 14 is provided in a gas line 16 for controlling the flow of a combustible fuel gas from a source (not shown) to a burner 17 located within the heat exchanger 12. A room thermostat 18 is connected to a first temperature limit switch 20 located at the outlet of the circulator 10 and to a second temperature limit switch 22 located at the outlet of the heat exchanger 12. The room thermostat 18 in combination with the operation of the first and second limit switches 20, 22 is arranged to control via an output line 24 an energizing signal to the gas valve 14.

The location of the second limit switch 22 near the bottom or outlet of the heat exchanger 12 is used to enable the second limit switch 22 to be used for measuring or limiting the temperature of the delivered air. However, in the event of a total air circulator failure, this location of the second limit sensor 22 does not adequately limit the air temperature rise because the resulting hot air rises within the heat exchanger 12 to exceed the maximum allowable temperature at the inlet of the heat exchanger 12. Accordingly, the first limit switch 20 is then required at the inlet of the heat exchanger 12 to additionally limit the furnace temperature.

As shown schematically in FIG. 2, these temperature limit switches 20, 22 each include a single-pole, single-throw switch controlled by the corresponding sensed temperature and connected in series with one side of the room thermostat 18 to a first electrical supply line terminal 25 connected to an alternating current (A.C.) source (not shown). The other side of the room thermostat 18 is connected through the gas valve 14 to a second electrical supply terminal 26 connected to the other side of the energizing A.C. source. This arrangement enables either the thermostat 18 or one of the limit switches 20, 22 to turn off or deactuate the gas valve 14 by interrupting an energizing or actuating signal thereto. While such an arrangement is effective to control the air temperature rise in the event of a circulator failure, the need for two temperature controls in the form of the limit switches 20, 22 is also effective to maintain the cost of the control system at a relatively high level. The present invention is directed to a control system for achieving a similar control function to that provided by the system shown in FIG. 1 without the need for the first and second temperature limit switches 20, 22.

Figure 4:
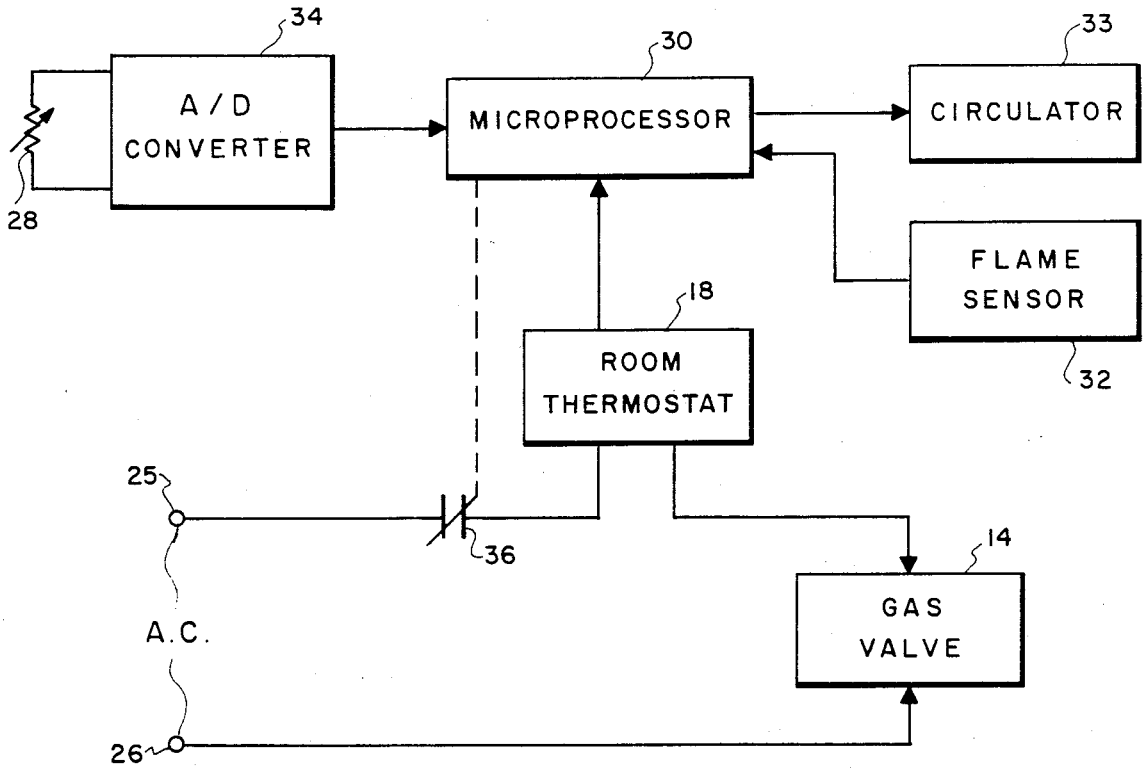
FIG. 4 is a schmetic illustration of the failure detector shown in FIG. 3

The control system shown in FIGS. 3 and 4 incorporates an example of an embodiment of the present invention wherein the first limit switch 20 used at the inlet of the heat exchanger 12 in the system illustrated in FIG. 1 is eliminated, and the second limit switch 22 used at the outlet of the heat exchanger 12 in the system shown in FIG. 1 is replaced by a relatively inexpensive analog temperature sensor 28. A microprocessor 30 is arranged to receive a signal from a flame sensor 32 arranged adjacent to the burner 17 in the heat exchanger. Additionally, the output signal from the temperature sensor 28 is converted by an analog-to-digital (A/D) converter 34 to a digital signal which is also supplied to the microprocessor 30. Further, the room thermostat 18 which is responsive to the temperature of the space 8 provides a separate means operating contemporaneously with the microprocessor 30 for controlling the gas valve 17.

The microprocessor 30 operates in accordance with a stored program and includes a memory (not shown) for storing the program and data on the reference or limit temperatures to be used for controlling the furnace 2 during the execution of the program. Thus, an output signal from the microprocessor 30 representative of the control operation exercised either by the microprocessor 30 in response to the aforesaid microprocessor input signals or by the thermostat 18 in response to the temperature of the heated space 8 is used to control the energization or actuation of the gas valve 14 to control the flow of gas to the burner 17 in the furnace 2. Specifically, the output signal from the microprocessor 30 is used to control the connection of the gas valve 14 to the A.C. source at the input terminals 25, 26 through a single-pole, single-throw switch 36. Concurrently, the thermostat 18 is connected in series with the switch 36 to provide an alternate control for the energization of the gas valve 14 from the A.C. source.

The microprocessor 30 performs the same high temperature limit function as described with respect to FIG. 1 in the event of a restriction in the return air path 4, e.g., a clogging of an air filter (not shown), without the need for the second limit switch 22 by determining that the delivered air temperature from the outlet of the heat exchanger 12 is greater than a first predetermined temperature limit stored in the microprocessor memory, e.g., 160° F. and representative of a maximum delivered air temperature. This delivered air temperature is sensed by the analog sensor 28 and is supplied as a representative digital signal to the microprocessor 30 by the A/D converter 32. Additionally, the microprocessor 30 is arranged to determine the presence of a circulator failure without the need for the first limit switch 20 shown in FIG. 1 by utilizing a predetermined control sequence. Thus, after a predetermined time e.g., 10 seconds, after the circulator start signal is supplied by the microprocessor 30, the microprocessor 30 compares the temperature signal from the temperature sensor 28 supplied through the A/D converter 34 with a second reference temperature stored in a microprocessor memory representative of the delivered air temperature prior to the start of the circulator 33. If the delivered air temperature at the location of the sensor 28 is not greater than the predetermined second reference temperature by a preset amount, e.g., 20°, the microprocessor 30 supplies an output signal to open the switch 36 which is in series with the gas valve 14 and, thus, interrupt the energization of the gas valve 14 to stop the gas flow to the burner 17.

Figure 5:
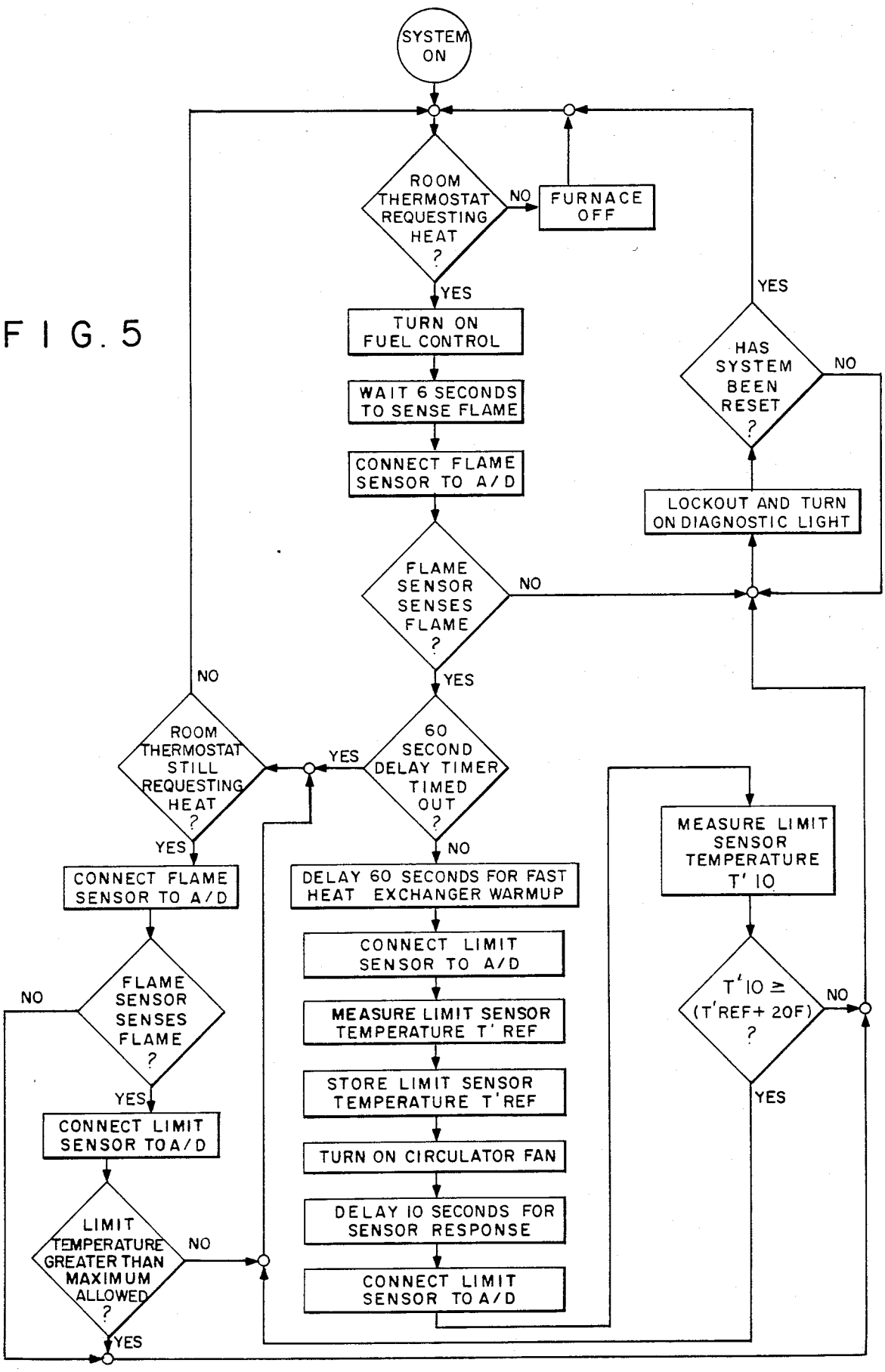
FIG. 5 is a flow chart illustrating an example of the operation of the microprocessor used in the detector shown in the FIGS. 3 and 4.

Thus, the microprocessor 30 is effective to control the energization of the gas valve 14 if either of the two temperature criteria are not met by the temperature of delivered air from the furnace 2. In FIG. 5, there is shown a flow chart for an example of a microprocessor program used by the microprocessor 30 for monitoring the operation of the heating system to determine abnormal conditions therein. This flow chart would, of course, be implemented by a stored program in the microprocessor 30. While the invention has been illustrated in a forced warm air furnace application, it should be noted that it is equally applicable for furnaces supplying other heat carrying media, e.g., water, wherein the induced or forced flow of the heating medium would be counter to the normal temperature induced flow, i.e., convection. The circulator 10 for a hot water system would, of course, be a water pump while the rest of the furnace control would be substantially the same as that described above with respect to FIGS. 3, 4 and 5.

Accordingly, it may be seen that there has been provided, in accordance with the present invention, an improved circulator failure detector for a downflow furnace.

The embodiments of the invention in which an exclusive property or privilege is claimed are defined as follows:

1. A furnace control apparatus comprising fuel combustion means for heating a heating medium, a furnace fuel supply valve arranged to supply fuel to said combustion means, valve control means for controlling the actuation of said valve to control the flow of fuel therethrough, circulator means for supplying the heating medium from the furnace after heating by said combustion means by inducing a flow of the heating medium counter to a temperature induced flow of the heating medium produced by said combustion means, temperature measuring means for sensing the temperature of the heating medium supplied from the furnace by said circulator means and producing an output signal representative of the sensed temperature and logic means responsive to an energization of the circulator means and the output signal from the temperature measuring means for controlling said valve control means initially to admit fuel to said combustion means during a start-up of the furnace and subsequently to interrupt the flow of fuel through said valve when the temperature of the heating medium fails to reach a first reference temperature after a predetermined time period following the energization of the circulator means.

2. A furnace control apparatus as set forth in claim 1 wherein said fuel combustion means includes a gas burner and said fuel supply valve is a gas valve arranged to supply a combustible gas to said gas burner.

3. A furnace control apparatus as set forth in claim 1 wherein said heating medium is air and said circulator means includes a fan arranged to urge said air from the furnace.

4. A furnace control as set forth in claim 1 wherein said logic means includes a microprocessor means operating in accordance with a stored program controlling said valve and a memory means for storing the program and said reference temperature.

5. A furnace control as set forth in claim 4 wherein said temperature sensing means includes a thermocouple or thermistor and an analog-to-digital converter for converting an output signal from said thermocouple to a digital input signal for said microprocessor means.

6. A furnace control as set forth in claim 1 wherein said logic means is arranged to interrupt the flow of fuel through said valve when the temperature of the heating medium exceeds a second reference temperature.

7. A furnace control as set forth in claim 6 wherein said logic means includes a microprocessor means operating in accordance with a stored program for controlling said valve and a memory means for storing said program and said first and second reference temperatures.

8. A furnace control as set forth in claim 7 wherein said temperature sensing means includes a thermocouple or thermistor and an analog-to-digital converter for a converting an output signal from said thermocouple to a digital input signal for said microprocessor means.

9. A furnace control as set forth in claim 1 wherein said valve control means includes a thermostat means responsive to a temperature of a space to be heated by the furnace for controlling in combination with said logic means an energization of said valve.

10. A furnace control as set forth in claim 9 wherein said logic means includes a single-pole, single-throw switch and said valve control means includes an electrically energizable actuation coil for said valve connected in series with said switch and said thermostat across a source of an energizing signal for said coil.

11. A furnace control apparatus comprising:

a heating medium circulator means for delivering a heating medium heated by the furnace, a temperature detector for sensing the temperature of the heating medium delivered from the furnace by said circulator means, and a fuel control means responsive to an output from said detector for interrupting a flow of fuel to the furnace when the temperature of the delivered heating medium fails to reach a predetermined reference temperature after a preset time period following a start of the operation of the delivery of the heating medium by said circulator means from the furnace.

12. A furnace control as set forth in claim 11 wherein the heating medium is delivered from the furnace by an artifically induced flow counter to a temperature induced flow.

13. A furnace control as set forth in claim 12 wherein the heating medium is air and further including an air circulator means for inducing the artifically induced flow.

14. A furnace control as set forth in claim 11 wherein the fuel is a combustible gas and said fuel control means includes a gas valve controlling the flow of said gas to the furnace.

15. A furnace control as set forth in claim 11 wherein said fuel control means includes a fuel flow valve means, a microprocessor means operating according to a stored program for controlling the fuel flow valve means and a memory means for storing the program and said temperature.

16. A method of operating a furnace including the steps of initiating a combustion of fuel in the furnace, inducing a circulation of a heating medium heated by the combustion of fuel in the furnace, monitoring the temperature of the heating medium delivered from the furnace following the initiation of the circulation of the heating medium and interrupting the combustion of the fuel when the temperature of the heating medium fails to reach a predetermined reference temperature after a preset time period following the start of the operation of the delivery of the heating medium from the furnace.

17. A method as set forth in claim 6 and including the further step of monitoring the temperature of a space to be heated by the furnace and initiating the combustion of fuel in the furnace upon the attainment of a predetermined temperature of the space to be heated.

18. A method as set forth in claim 16 wherein the circulation of the heating medium is counter to a temperature induced flow of the heating medium.

19. A method as set forth in claim 16 and including the further step of interrupting the combustion of the fuel when the temperature of the heating medium exceeds a second predetermined reference temperature.

20. A method as set forth in claim 19 wherein the second temperature is higher than the first temperature.

* * * * *